US008732956B2

(12) United States Patent
McGushion et al.

(10) Patent No.: US 8,732,956 B2
(45) Date of Patent: May 27, 2014

(54) SAFETY LOCKING MECHANISM FOR A UTILITY KNIFE

(76) Inventors: Aaron Paul McGushion, Seal Beach, CA (US); Earl Votolato, Newport Beach, CA (US); David A. Sharbaugh, Irvine, CA (US)

( * ) Notice: Subject to any disclaimer, the term of this patent is extended or adjusted under 35 U.S.C. 154(b) by 417 days.

(21) Appl. No.: 13/161,330

(22) Filed: Jun. 15, 2011

(65) Prior Publication Data

US 2012/0317820 A1 Dec. 20, 2012

(51) Int. Cl.
*B26B 3/06* (2006.01)
*B26B 29/02* (2006.01)

(52) U.S. Cl.
USPC ..... 30/151; 30/2; 30/153

(58) Field of Classification Search
USPC ..... 30/2, 151, 286, 161, 288, 294
See application file for complete search history.

(56) References Cited

U.S. PATENT DOCUMENTS

| | | | | |
|---|---|---|---|---|
| 3,943,627 | A | 3/1976 | Stanley, Jr. | |
| 4,091,537 | A | 5/1978 | Stevenson, Jr. | |
| 4,757,612 | A | 7/1988 | Peyrot | |
| 4,931,042 | A | 6/1990 | Holmes et al. | |
| 4,980,977 | A | 1/1991 | Matin et al. | |
| 5,241,750 | A | 9/1993 | Chomiak | |
| 5,330,494 | A | 7/1994 | van der Westhuizen et al. | |
| 5,522,135 | A * | 6/1996 | Votolato | 30/2 |
| 5,662,669 | A | 9/1997 | Abidin et al. | |
| 5,878,501 | A * | 3/1999 | Owens et al. | 30/286 |
| 5,890,290 | A | 4/1999 | Davis | |
| 6,148,520 | A | 11/2000 | Berns | |
| 6,233,832 | B1 | 5/2001 | Berns | |
| 6,308,418 | B1 * | 10/2001 | Sweet | 30/136 |
| 6,453,559 | B1 | 9/2002 | Marshall et al. | |
| 6,560,873 | B1 | 5/2003 | Ortner et al. | |
| 6,578,266 | B2 * | 6/2003 | Chomiak | 30/2 |
| 6,643,936 | B2 | 11/2003 | Carlson et al. | |
| 6,718,637 | B1 * | 4/2004 | Ortner et al. | 30/2 |
| 6,718,640 | B1 | 4/2004 | John | |
| 6,785,966 | B2 | 9/2004 | Berns | |
| 7,082,688 | B2 | 8/2006 | Votolato | |
| 7,178,248 | B2 * | 2/2007 | Richards | 30/520 |
| 7,356,928 | B2 * | 4/2008 | Votolato | 30/2 |
| 7,475,480 | B2 * | 1/2009 | Votolato | 30/2 |

(Continued)

FOREIGN PATENT DOCUMENTS

| | | |
|---|---|---|
| DE | 8912929.6 | 2/1990 |
| EP | 0252711 A1 | 1/1988 |
| WO | 94/04324 | 3/1994 |

*Primary Examiner* — Boyer D Ashley
*Assistant Examiner* — Fernando Ayala
(74) *Attorney, Agent, or Firm* — Robert J. Lauson; Lauson & Tarver LLP

(57) ABSTRACT

A safety mechanism for a utility knife is provided to prevent more than one retraction of the blade shield for each trigger actuation. A separable linkage extends between an actuator and a strut, and has a seat member and a deflecting member that are linked together when the actuator is not depressed and the strut is in the safety position blocking the retraction of the shield. The separable linkage is configured to transmit the pressing action of the actuator to the strut to disengage it from the bracket. The separable linkage is configured to delink as the shield retracts. If the actuator continues to be pressed in after the shield returns from being retracted, the safety mechanism prevents relinking of the seat member and the deflecting member, due to the deflecting member being deflected away from the seat member in a substantially longitudinal direction.

16 Claims, 8 Drawing Sheets

(56) References Cited

U.S. PATENT DOCUMENTS

| | | | | |
|---|---|---|---|---|
| 7,509,742 | B2 | 3/2009 | Votolato | |
| 7,774,942 | B2 | 8/2010 | Schmidt | |
| 7,814,664 | B2 * | 10/2010 | LeBlanc et al. | 30/161 |
| 7,886,443 | B2 | 2/2011 | Votolato | |
| 8,122,605 | B2 * | 2/2012 | Votolato | 30/2 |
| 8,209,870 | B2 * | 7/2012 | Votolato et al. | 30/151 |
| 2002/0124412 | A1 | 9/2002 | Votolato | |
| 2002/0124418 | A1 | 9/2002 | Votolato | |
| 2004/0093734 | A1 * | 5/2004 | Votolato | 30/2 |
| 2006/0048389 | A1 * | 3/2006 | Votolato | 30/2 |
| 2007/0068000 | A1 * | 3/2007 | Onion | 30/160 |
| 2008/0163493 | A1 * | 7/2008 | Votolato | 30/154 |
| 2009/0172889 | A1 * | 7/2009 | Votolato | 7/158 |
| 2009/0223066 | A1 | 9/2009 | Votolato | |
| 2009/0271988 | A1 | 11/2009 | Votolato | |
| 2011/0167646 | A1 * | 7/2011 | Schmidt | 30/151 |

* cited by examiner

SAFETY LOCKING MECHANISM FOR A UTILITY KNIFE

BACKGROUND

In many personal and industrial applications, safety knives are desirable to prevent user laceration both before a cut is made and immediately subsequent to a cut. These safety knives may be disposable or designed for extended use. The knives that are used for extended periods may have replaceable blades or blade cartridges so that the handle and related safety apparatus may be reused while still maintaining a sharp cutting edge. The disposable knives may have the blade permanently attached to within the safety knife, so that the knife is discarded once the blade becomes dull. For example, the disposable knife is desirable in the food services industry, where loose blades from replaceable blade knives may find their way into the food product. A permanently attached blade forces the user to discard the entire knife rather than just change the blade. To reduce replacement costs incurred by the customer, these disposable knives are often made of inexpensive plastic materials with the least possible number of injection molded parts and moving parts.

Some safety knives have blade covers that may be retracted upon actuation of a trigger or similar actuation means. When locked, these blade covers are prevented from retracting due to the blade cover movement being blocked by a pawl-like mechanism that engages a stop. Only after being disengaged from the stop, can the blade cover be retracted to expose the blade. Some of these newer safety knives further include features that permit just one blade cover retraction for each trigger pull. If the trigger is continuously pressed after the blade cover has been retracted rather than released, the blade cover will still become locked in the extended position. Only after releasing the trigger and depressing the trigger a second time will the blade cover be permitted to retract once again.

The single-use per press feature has been achieved at this point through use of complex mechanisms that require tight tolerances and close fits between parts. For example, much of the art has required the use of one-way ramp features, such that a moving part must ride up the ramp feature, thereafter falling off a ledge so that the part may not return to the previous position until a second actuation has occurred. This ramped design requires the moving part to be closely and exactly situated relative to the ramp feature. The ramped feature must be small, however, so that movement of the moving part up the ramp is not unduly hindered. Further, many current designs require flexible plastic parts, which tend to fatigue and slightly change shape, causing parts to eventually lose contact or move out of optimal alignment. Small features combined with close tolerances between moving parts create a safety mechanism that is relatively expensive to manufacture, and potentially unreliable due to part fatigue.

Since many of the safety knives are disposable or otherwise have short lives, any added expense greatly detracts from the competiveness of the knife. It is desirable to eliminate tight tolerances when the product is disposable to ultimately reduce costs and encourage timely disposal of the knife to prevent usage when dull. It is desirable to have a safety knife that is inexpensive to manufacture and more reliable due to the loosening of tolerances, reduction in parts and overall simplification of the mechanism.

SUMMARY

The present utility knife is an entirely new and creative design, offering significant advantages over the prior art. The safety mechanism operates within the utility knife that has a blade extending from the knife. A retractable shield protects the user from the cutting edge of the blade. When a strut is in a safety position, it is engaged between the shield and a bracket so that the shield is prevented from retracting to expose the cutting edge. A separable linkage extends between an actuator and the strut. The separable linkage comprises a seat member and a corresponding deflecting member that are linked together when the actuator is not depressed and the strut is in the safety position. The separable linkage is configured to transmit the pressing action of the actuator to the strut to disengage it from the bracket. Once the strut is displaced from the bracket, retracting the shield causes the strut to move relative to the bracket substantially in the longitudinal direction, causing a delinking of the seat member and the deflecting member. If the actuator continues to be pressed in after the shield returns from being retracted, the safety mechanism prevents relinking of the seat member and the deflecting member due to the deflecting member being deflected away from the seat member in a substantially longitudinal direction.

Alternately, the safety mechanism operates within a utility knife that has a blade extending from the knife. A retractable shield protects the user from the cutting edge of the blade. When a strut is in a normal position, it is braced between the shield and a stop so that the shield is prevented from retracting to expose the cutting edge. A separable linkage has a first member and a second member which have a linked mode where they are in compressive alignment. When in compressive alignment, the first member and the second member are aligned so that actuation of the trigger disengages the strut form the stop. The separable linkage additionally has a delinked mode where the first member is moved out of compressive alignment with the second member.

LISTING OF REFERENCE NUMERALS OF FIRST-PREFERRED EMBODIMENT

Figure 1:
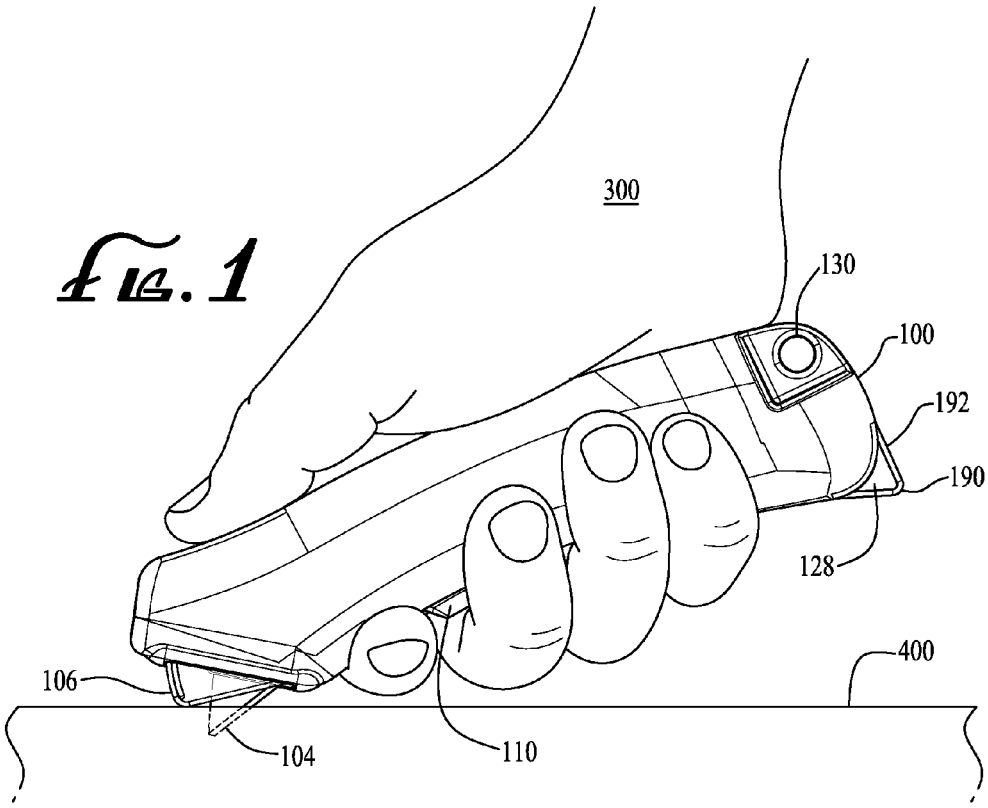
FIG. 1 is a side view of an example embodiment of a utility knife, showing the utility knife held within a user's hand, making a cut.

| LISTING OF REFERENCE NUMERALS of FIRST-PREFERRED EMBODIMENT | |
|---|---|
| utility knife | 100 |
| safety mechanism | 102 |
| blade | 104 |
| shield | 106 |
| blade holder | 108 |
| actuator | 110 |
| spring | 112 |
| strut | 114 |
| forward end | 116 |
| aft end | 118 |
| separable linkage | 120 |
| deflecting member | 122 |
| seat member | 124 |
| channel | 126 |
| tape splitter | 128 |
| lanyard hole | 130 |
| lanyard hole | 131 |
| body | 132 |
| first shell or right housing | 134 |
| second shell or left housing | 136 |
| lip | 138 |
| flexing arm | 140 |
| protrusion | 142 |
| protrusion | 143 |
| bracket | 144 |
| bracket | 145 |
| slide | 146 |
| slide | 147 |
| arced groove | 148 |
| arced groove | 149 |
| hook | 150 |
| hook | 152 |

-continued

| LISTING OF REFERENCE NUMERALS of FIRST-PREFERRED EMBODIMENT | |
|---|---|
| flexible arm | 154 |
| knob | 156 |
| knob | 157 |
| post | 158 |
| post | 159 |
| opening | 160 |
| opening | 161 |
| tubular post | 162 |
| tubular post | 163 |
| back | 164 |
| hollow boss | 166 |
| hollow boss | 167 |
| post | 168 |
| post | 169 |
| post | 170 |
| post | 171 |
| hole | 172 |
| opening | 174 |
| opening | 175 |
| wall | 176 |
| wall | 177 |
| hump | 178 |
| fixed end | 180 |
| free end | 182 |
| seat portion | 184 |
| deflector portion | 186 |
| limiter | 188 |
| tip | 190 |
| edge | 192 |
| bearing | 194 |
| underside | 196 |
| rib | 198 |
| rib | 199 |
| tab | 200 |
| cornered portion | 202 |
| cornered portion | 203 |
| platform | 204 |
| side | 206 |
| user | 300 |
| workpeice | 400 |

DESCRIPTION OF THE PREFERRED EMBODIMENTS

FIG. 1 illustrates the usage of the present utility knife (100) to cut workpeice (400), such as a box or other cardboard-like packaging. The body (132) of the knife (100) is ergonomically shaped to fit comfortably within the hand of a user (300). The shield (106) is normally locked so that it may not be retracted until the actuator or trigger (110) is depressed or otherwise actuated. The user (300) presses actuator (110) to unlock the shield (106) that is biased to cover the blade (104) and prevents exposure of the cutting edge of the blade (104) when not in use. After depressing the trigger (110), the shield (106) may be rotated or retracted by applying the shield (106) to the workpeice (400) surface, such as the surface of a box or other item to be cut. Upon retraction of the shield (106), the blade (104) may be plunged into the workpeice (400) to a relatively shallow depth, sufficient for cutting into product packaging and the like without damage to the product within. This depth can be determined by the degree of shield (106) retraction, the length of the blade (104), and the user (300) input. The blade (104) may be of a variety of suitable blades, including blades with a straight cutting edge, a hooked or curved cutting edge, or a serrated cutting edge.

Figure 2:
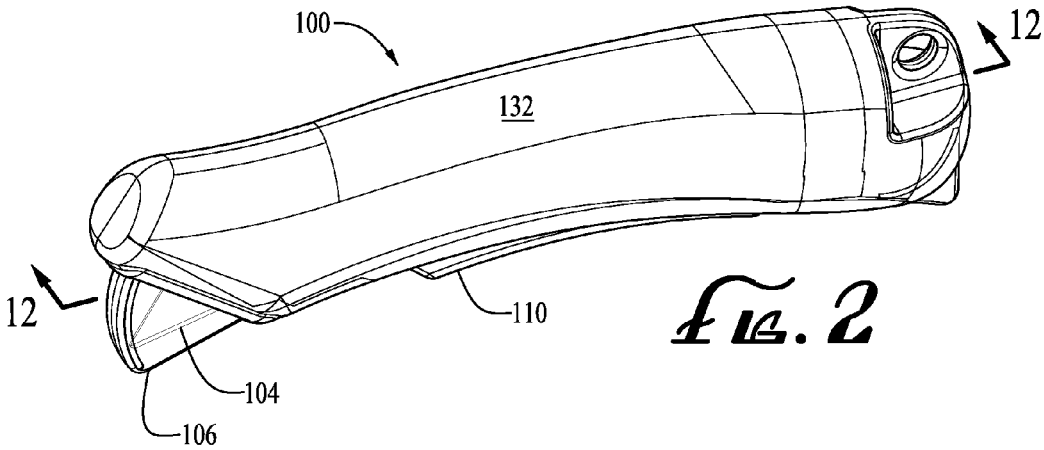
FIG. 2 is a side perspective view of the utility knife of FIG. 1.

Often, the user (300) will draw the knife (100) towards himself during the cutting process. Upon reaching the edge of the workpeice (400) the blade (104) exits the workpeice (400) and the resistive drag of the workpeice (400) on the blade (104) is eliminated, often causing the knife (100) within the user's hand to leave the workpeice (400) with great velocity towards the user's body. The shield (106) is biased to immediately extend to cover the blade (104) upon losing contact with the workpeice (400). FIG. 2 illustrates the shield (106) extended to cover the blade (104). At a minimum, the cutting or sharpened edge of the blade (104) should be shielded, such that the user (300) is substantially prevented from contacting the cutting edge. The present safety mechanism (102) is designed to relock the shield (104) upon extension of the shield (106), whether the user has released the trigger (110) or has continued to hold the trigger (110) in the depressed position. This relocking capability whether or not the trigger (110) is actuated is a critical safety feature of the present safety mechanism (102). If the shield (106) were to simply extend over the blade (104) without relocking, the shield (106) would be free to retract once again after leaving the workpeice (400), possibly causing a severe laceration to the user's body. By relocking the shield (106) upon leaving the workpeice (400), the shield (106) will not retract a second time and will protect the user (300) from laceration.

Figure 4:
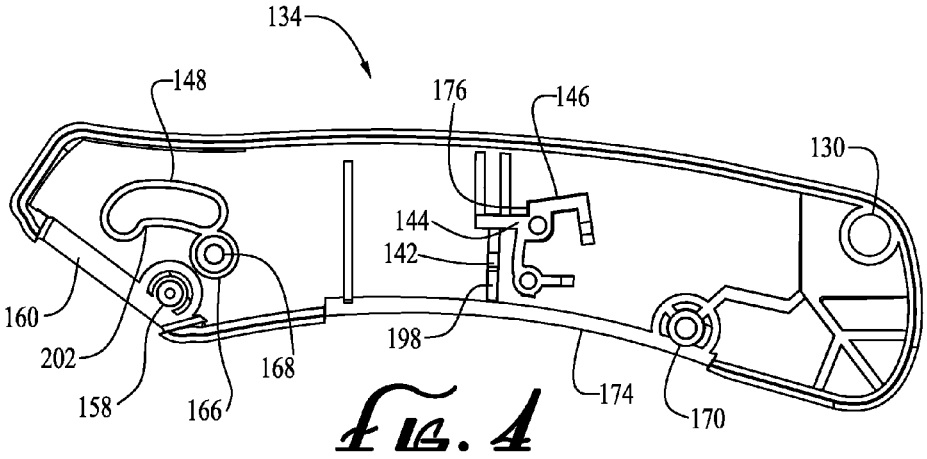
FIG. 4 is a side view of the first shell or right housing of the utility knife as shown in FIG. 3, showing the internal details of the first shell.
Figure 5:
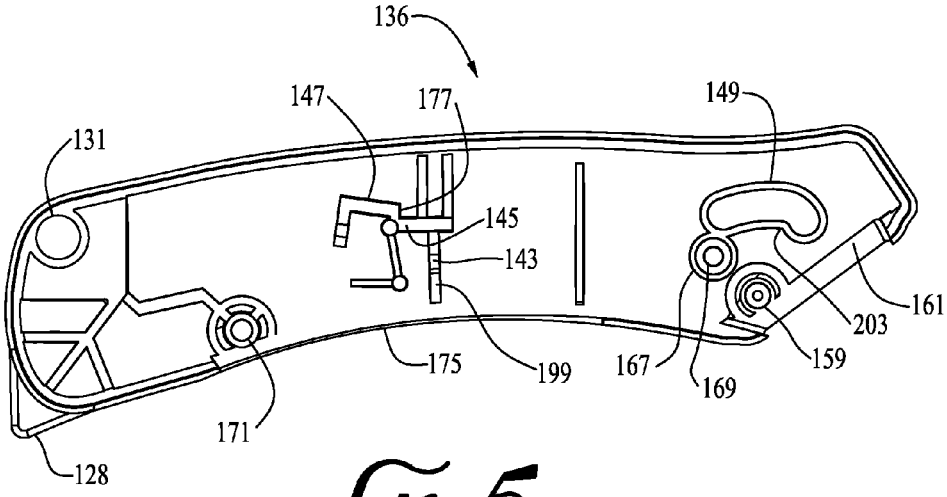
FIG. 5 is a side view of the second shell or left housing of the utility knife as shown in FIG. 3, showing the internal details of the second shell.

For the user's convenience, a tape splitter (128) may be formed on the aft end of the knife (100). The tape splitter (128) extends from the body (132), has a tip (190) for piercing the tape, and has an edge (192) generally sharp enough to split the tape but not sharp enough to cut the user. The tape splitter (128) is preferably integrally molded on the aft end of one of the shells (134, 136). For example, FIGS. 4-5 show the tape splitter (128) molded on the second shell (136). Although not shown, it is readily apparent when viewing FIG. 1 that the knife (100) can be safely held with the tape splitter (128) end or aft end towards the workpeice (400) for splitting tape or other material. A lanyard hole (130), and corresponding lanyard hole (131) of the second shell (136), may also be provided for lacing through a lanyard or other cord. The utility knife (100) may also be hung when not in use by hooking a nail or hook through the lanyard hole (130) itself.

Figure 3:
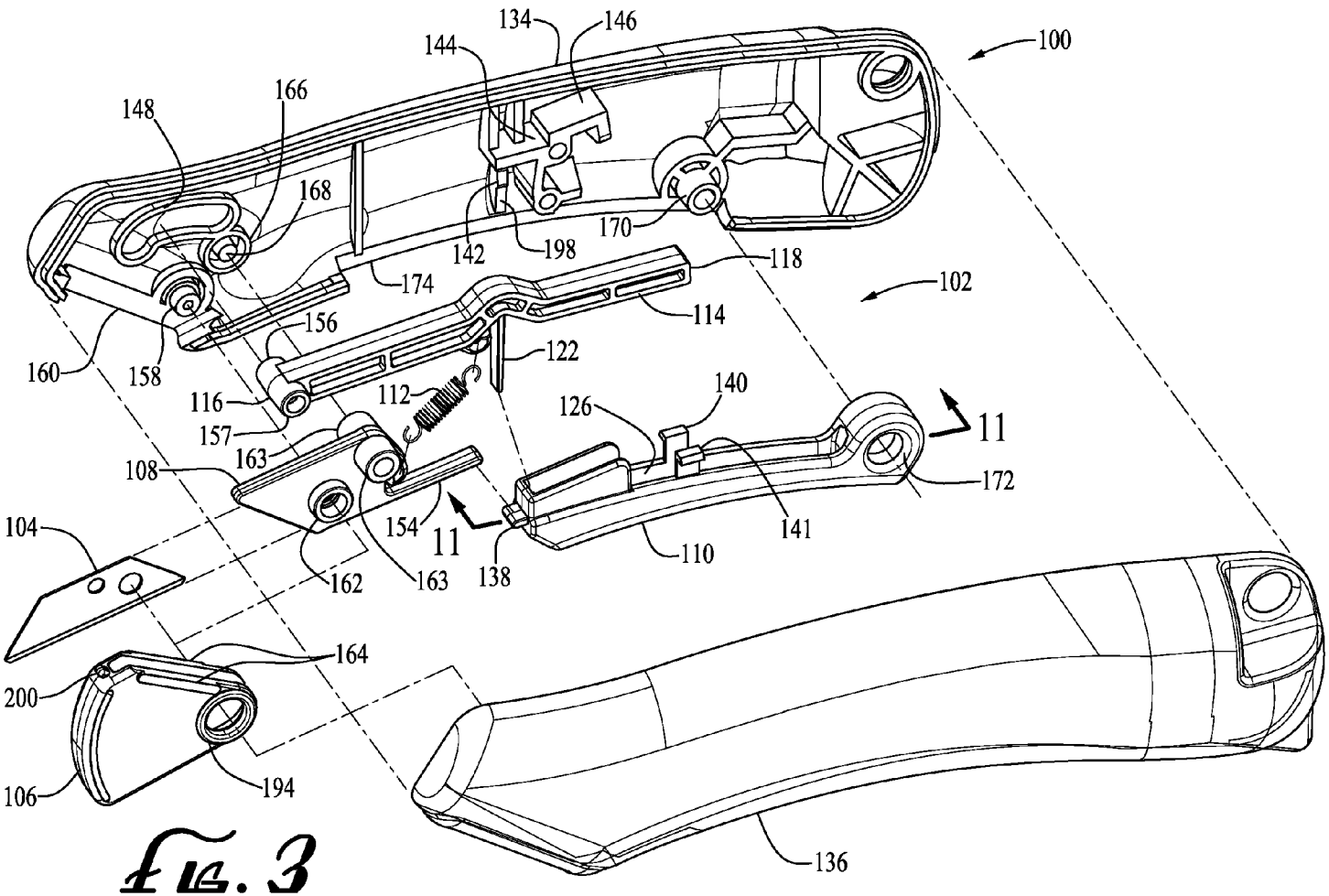
FIG. 3 is an exploded perspective view of the utility knife of FIG. 1, showing the safety mechanism thereof.

An exploded perspective view of the present utility knife (100) is illustrated in FIG. 3, with dashed lines indicating the assembled interrelationships between the various parts. The present embodiment of the utility knife (100) is shown with a first shell (134) that mates with a corresponding second shell (136) to form a housing or body (132) with a hollow interior for holding therein the various parts of the safety mechanism (102) and other parts of the knife (100). The first shell (134) and second shell (136) may be permanently joined by a snap feature or other means, such as ultrasonic welding. With minor variations, the first shell (134) substantially mirrors the construction of the second shell (136). At the forward end of both shells (134, 136) an opening (160) and corresponding opening (161) are formed so that the blade (104) and shield (106) may extend there through from the interior to the exterior of the body (132). The safety mechanism (102) comprises a first member in compressive alignment with a second member and extending between an actuator and a strut, such that the movement of the actuator lifts the strut through the compressively aligned members; and movement of the strut causes the members to be misaligned. Further, the strut (114) is permitted to return to a safety or locked position even when the trigger (110) is depressed due to at least one member having a deflection approximately parallel to the longitudinal movement of the strut (114). Specifically in the present embodiment, the safety mechanism (102) comprises a strut (114) with a deflecting member (122) extending therefrom in approximately a transverse direction relative to the longitudinal or lengthwise axis of the strut (114), a trigger (110) with a seat member (124), the seat member (124) and the deflecting member (122) are configured to be in compressive alignment when the trigger (110) is not actuated and the strut (114) is in the locked safety position. Further, the deflecting member (122) is configured to bend or deflect with a forward or aft deflection (along the longitudinal direction) when the trigger (110) remains depressed after the shield (106) has extended over the blade (104) after a cut. The bending occurs due to the misalignment between the seat member (124) and the deflecting member (122), where the deflecting member (122) bends against the side or the deflecting portion (186) of the seat member (124), although the deflecting member (122) may contact an alternate surface to facilitate bending.

A blade holder (108) is provided for securely holding the blade (104) which extends from the body (132). On each side of the blade holder (108) is a tubular post (162) with an internal diameter sized to fit over a post (158) and post (159) formed on the respective interiors of each of the shells (134, 136). To create four points of attachment to the body (132), the blade holder (108) is provided with tubular posts (163) on each side. The tubular post (163) internal diameter is sized to fit over post (168) and an external diameter sized to be inserted within hollow boss (166), corresponding to opposing post (169) and hollow boss (167). The four attachment points provided by the two sets of tubular posts (162, 163) insure secure mounting of the blade holder (108) within the body (132). The blade holder (108) is preferably injection molded about the metal blade (104), forming an integral blade assembly. The blade (104) may have various holes formed though it that correspond to the tubular posts (162) of the blade holder (108) or for permitting the injected plastic to flow through to further secure the blade (104) to the blade holder (108). The blade holder (108) may be molded from any suitable material, such as nylon, acetal, ABS, or other durable and, optionally, resilient polymers. The blade holder (108) may either be permanently secured within the body (132) as illustrated in the shown embodiment or may configured to be replaceable, where the blade holder (108) and blade (104) are temporarily secured by a latch mechanism or the like.

Extending from the rear of the blade holder (108) is a flexible arm (154) designed to contact and press down upon a lip (138) formed on the trigger (110) to bias the trigger (110) so that it normally extends through opening (174) on the first shell (134) and corresponding opening (175) on the second shell (136). The flexible arm (154) is a spring element designed to keep the trigger (110) fully extended when not actuated. As the trigger (110) is depressed, the lip (138) bends the flexible arm (154) to provide slight resistance to the user's input. Upon releasing the trigger (110), the flexible arm (154) rebounds and returns the trigger (110) to fully extended state. The trigger (110) may be alternatively biased in numerous ways, as is known in the art, such as using metal or plastic leaf springs, torsion springs, or the like. The trigger (110) hinges on the body (132) on a post (170) formed on the first shell (134) and corresponding post (171) formed on a second shell (136).

The shield (106) is shown as generally being wedge-shaped with a slot formed through it to accommodate the blade (104) and blade holder (108). A bearing (194) or through hole is formed through each side of the shield (106) and correspond to the external diameters of tubular posts (162) to form a plain bearing, permitting rotation of the shield (106) about the hollow posts (162). The backs (164) of the shield (106) are configured to contact the knob (156) and knob (157) formed on the forward end (116) of the strut (114) so that the knobs (156, 157) follow and ride the backs (164) as the shield (106) retracts and extends. Although not required, the shield (106) is preferably injection molded using a transparent material so that the user may see location of the blade (104) through the extended shield (106). The clear shield (106) also aids in detecting and clearing contamination of the blade (104). The ability to maintain a clean blade (104) and shield (106) is a desirable feature in the food service industry.

The strut (114) has a forward end (116) and an aft end (118), and is generally elongate in shape. At the forward end (116), a knob (156) extends from each side of the strut (114) in a direction generally horizontally transverse to the longitudinal or lengthwise axis of the strut (114). Each knob (156) is sized to fit within a corresponding arced groove (148) formed on each of the interiors of the shells (134, 136). The arced grooves (148) may be formed on the interior surface by forming a wall to enclose a kidney-shaped area. A coil spring (112) is attached between the strut (114) and the blade holder (108) to generally bias the strut (114) to the forward direction and the downward direction towards the trigger (110). However, one or more springs may be attached to the strut (114) by one end and numerous other suitable points by the other end for biasing the strut (114) and shield (106). Under the bias of the spring (112), the knobs (156) normally push upon the backs (164) of the shield (106) to bias the shield to extend over the blade (104), where the knobs (156) are located at the forward end of the arced grooves (148). As the shield (106) is retracted, the backs (164) contact and push the knobs (156) and strut (114) longitudinally in the aft direction against the bias of the spring (112).

Figure 7:
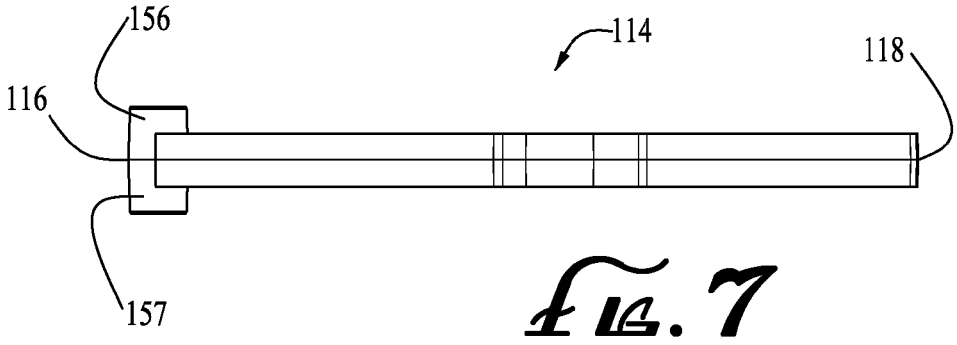
FIG. 7 is a top view of the strut of FIG. 6.
Figure 8:
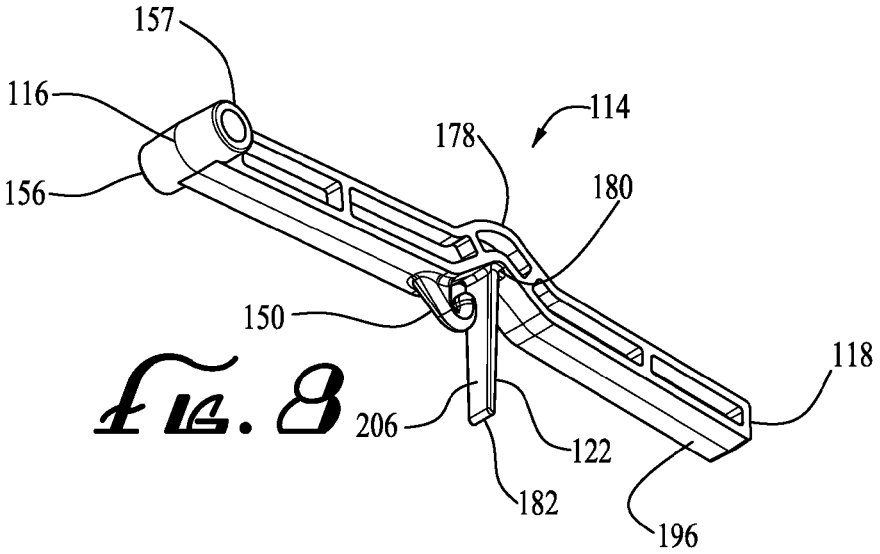
FIG. 8 is a bottom perspective view of the strut of FIG. 6.

Extending from the underside (196) of the strut (114) is a deflecting member (122). The deflecting member (122) is preferably molded integrally with the strut (114) and is cantilevered therefrom. The structure of the strut (114) can be seen in more detail when looking at FIGS. 6-8. The deflecting member (122) is cantilevered from the underside (196) of the strut (114), attached or molded thereto by a fixed end (180) and having a free end (182) at the tip. The deflecting member (122) has a generally elongate or rectangular cross section, having a major length generally transverse to the longitudinal axis of the strut (114), forming a T-like structure when viewed form the side. The longitudinal axis is generally along the length of the strut (114); and the travel or the path of the strut (114) is generally parallel to its longitudinal axis. The deflecting member (122) is permitted to bend about the fixed end (180), although thinned sections or other points of weakness may be created to encourage bending at various desired points. With the example arrangement shown, the deflecting member (122) bending is restricted to the forward and aft direction and substantial bending from side to side is restricted or restrained, as shown by the arrows in FIG. 6. However, if a deflecting member (122) with a round cross section were used, bending would be permitted in all directions. Bending or deflection in all directions is compatible with the present utility knife (100), but bending is primarily desired in the forward and/or aft directions, where the measured deflection (D) of the deflecting member (122) is approximately parallel to the travel or path of the strut (114). A deflecting member (122) that is connected to the strut (114) through a spring-loaded hinge arrangement is also compatible with the present embodiment.

The strut (114) may be constructed with various designs. One of the primary purposes of the strut (114) is to provide a substantially rigid linkage between the shield (106) and the shelf or bracket (144) to prevent the shield (106) from retracting to expose the blade (104), unless the user (300) has actuated the trigger (110). The forward end (116) of the strut (114) is linked with the shield (106) through sliding contact as shown, or may be hinged on the shield (106) with a clevis joint arrangement or similar connection. Additionally, the shield (106) and strut (114) may be molded integrally with a joint or thinned section to permit rotation of the shield (106) and strut (114) relative to one another. A hump (178) or arced section of the strut (114) may be included to provide clearance for lengthening the deflecting member (122) design to change bending characteristics.

A stop, shelf or bracket (144) is molded integrally on the interior wall of at least one of the first shell (134) or the second shell (136). Here, in FIGS. 4-5, the bracket (144) is fixed and formed on both of the shells (134, 136) to prevent the strut (114) and connected shield (106) from moving when in the safety position. The bracket (144) shown in the present embodiment is a shelf-like structure that is fixed relative to the movement of strut (114) and trigger (110). However, alternate design options are available for the bracket (144) location, so long as the bracket (144) can engage the strut (114) to prevent its movement when in a safety position.

Figure 9:
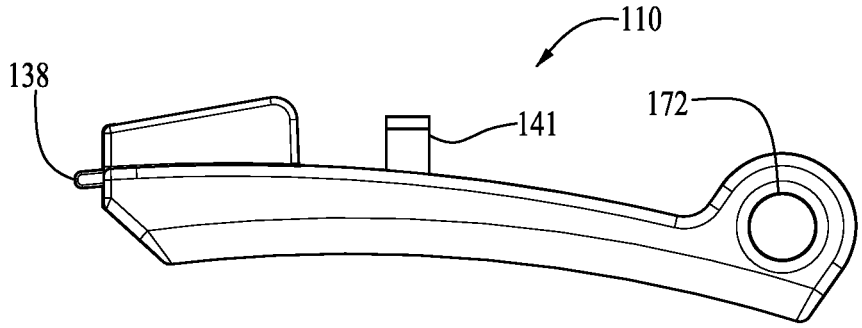
FIG. 9 is a side view of the actuator or trigger of the utility knife as shown in FIG. 3.
Figure 10:
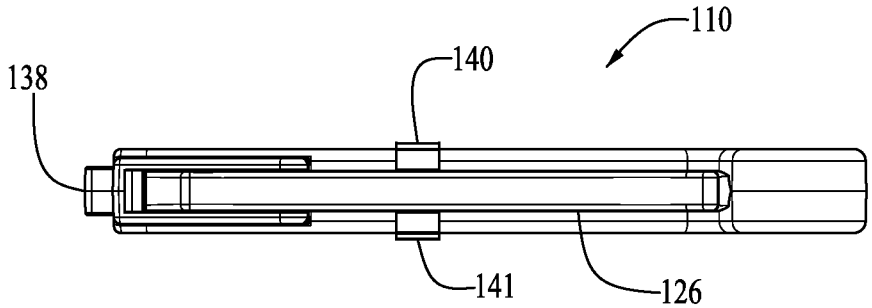
FIG. 10 is a top view of the trigger of FIG. 9.
Figure 11:
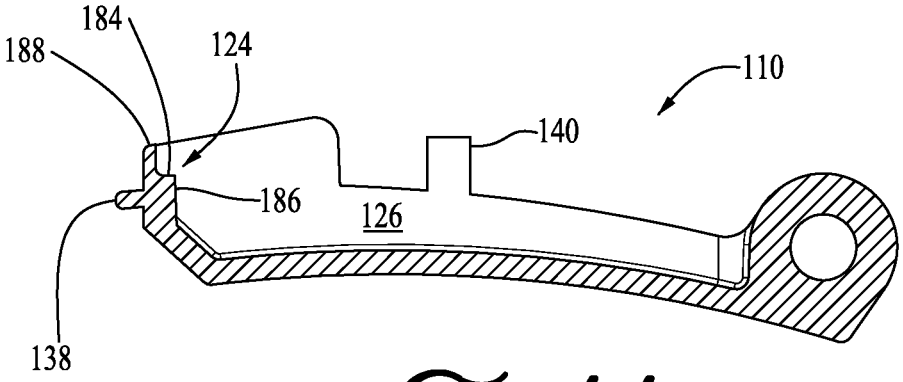
FIG. 11 is a side cross-sectional view of the trigger of FIG. 9 taken along section 11-11.

The trigger or actuator (110) can be seen with greater detail in FIGS. 9-11. The trigger (110) may be molded integrally with the body (132) or, as shown, formed as a separate part that is hinged on the body (132) through hole (172). The lip (138) is formed on the end of the trigger opposing the hinged end, so that the flexible arm (154) contacts the top side of the lip (138) and provides sufficient torque to bias the trigger (110) out of the body (132). Further, the lip (138) limits the outward travel of the trigger (110) due to the bottom side of the lip (138) contacting the inside wall of the body (132).

A seat member (124) is formed on the trigger and is optionally shown as being generally stepped-shaped. A generally horizontal surface forms a seat portion (184) with an adjacent vertical wall forming a deflecting portion (186). A vertical section rising above the seat portion (184) forms a limiter (188). The limiter (188) is configured to prevent the tip (182) of the deflecting member (122) from moving in an undesired direction. The limiting function can be provided by the limiter (188) on the seat member (124) or on the deflecting member (122), where a mechanical interference is created between the seat member (124) and deflecting member (124) to control the flexing or movement of the deflecting member (124) tip (182). The exact function of the seat member (124) relative to the deflecting member (122) will be discussed in greater detail below, in reference to FIGS. 12-21.

A channel (126) may be formed along the length of the trigger (110) for receiving the deflecting member (122) there within and accommodating the forward and aft travel of the deflecting member (122). The deflecting member (122) may move substantially linearly in the forward and aft directions relative to the seat member (124). Extending upwards from the trigger (110) are optional flexible arms (140), designed to deflect in a direction perpendicular to the plane through which the trigger (110) rotates. The flexible arms (140) are tab-like in construction and are molded integrally with the trigger (110).

Figure 14:
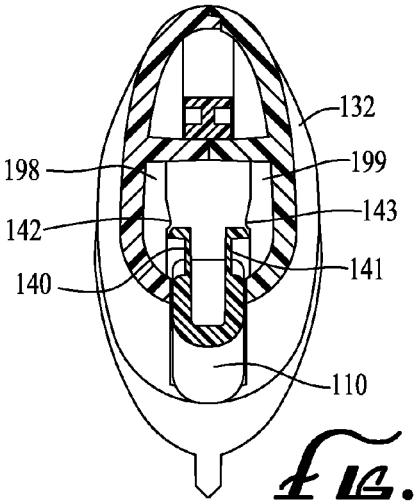
FIG. 14 is a front or forward cross-sectional view of the utility knife as shown in FIG. 12 taken along section 14-14, showing the detent mechanism when the trigger is released.
Figure 15:
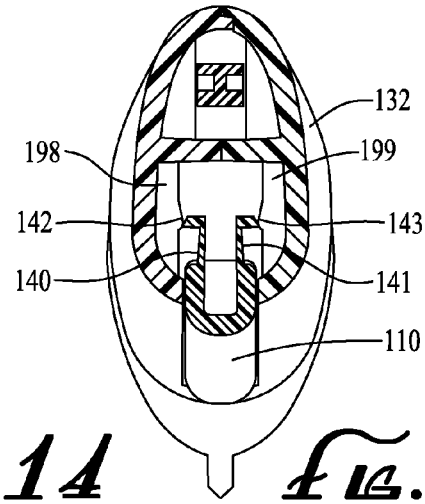
FIG. 15 is a front or forward cross-sectional view of the utility knife as shown in FIG. 13 taken along section 15-15, showing the detent mechanism when the trigger is depressed.

Looking at FIGS. 14-15, the exact operation of the detent mechanism created by the interaction between the protrusions (142) formed on the inside wall of the first shell (134) and the protrusion (143) formed on the inside wall of the second shell (136) and the flexible arms (140). In FIG. 14, which corresponds section 14-14 indicated in FIG. 12, the trigger (110) is not actuated and is fully extended. Each flexible arm (140, 141) has a horizontal extension with a beveled tip extending towards and contacting a rib (198) formed on the first shell (134) and a corresponding rib (199) formed on the second shell (136). The flexible arms (140, 141) are initially below the protrusions (142, 143). As the trigger (110) is depressed, the flexible arms (140) are brought into contact with the protrusions (142), where the rounded or ramped shape of the protrusion permits the beveled tip of the flexible arm (140) to ride up and over the protrusion (142), as seen in FIG. 15, corresponding to section 14-14 indicated of FIG. 12. If the trigger (110) were released, the flexible arms (140) would be permitted to travel in the opposite or downward direction over the protrusions (142). The detent action created provides an initial resistance to depressing the trigger (110) so that accidental trigger (110) pulls are reduced. Further, the detent action encourages full trigger (110) depression for optimal operation and positive feedback to the user (300). Although the detent mechanism is not a required component of the locking mechanism, it may be optionally included if desired.

Figure 6:
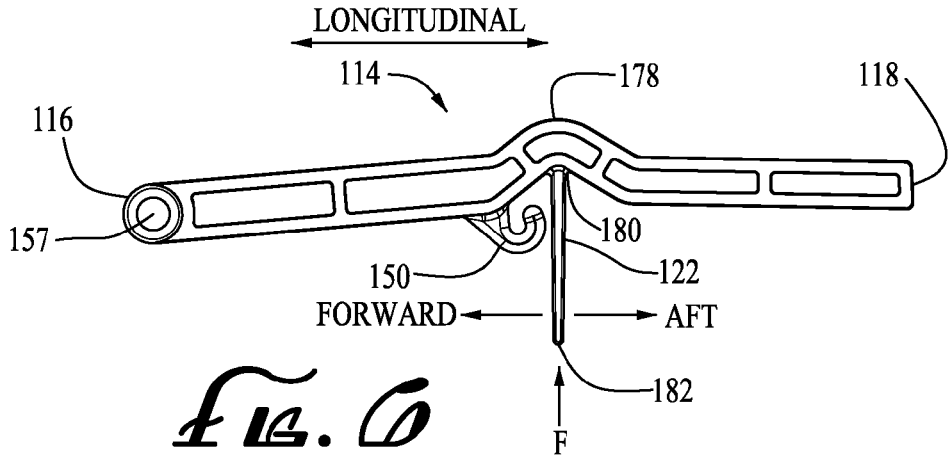
FIG. 6 is a side view of the strut of the utility knife as shown in FIG. 3.

FIGS. 12-13 and 16-21 show the present knife (100) in cross section along its length and illustrates the operation of the safety mechanism as the trigger (110) is depressed and a cut is made. First, looking at FIG. 12, the trigger (110) is not actuated and is fully extended. The seat member (124) and the deflecting member (122) form a separable linkage (120). When the free end or tip (182) of the deflecting member (122) is situated directly on or above the seat portion (184), the seat portion (184) is in a position to apply an axially-directed force through the tip (182) of the deflecting member (122) due to trigger (110) depression. The axially-directed force, indicated by the arrow marked F in FIG. 6, is substantially directed long the length of the deflecting member (122) to minimized bending or buckling. However, a force directed slightly off-axis is permitted, so long as the force does not create substantial bending of the deflecting member (122), such that the deflecting member (122) would fail to sufficiently lift the strut (114) above the bracket (144).

Figure 12:
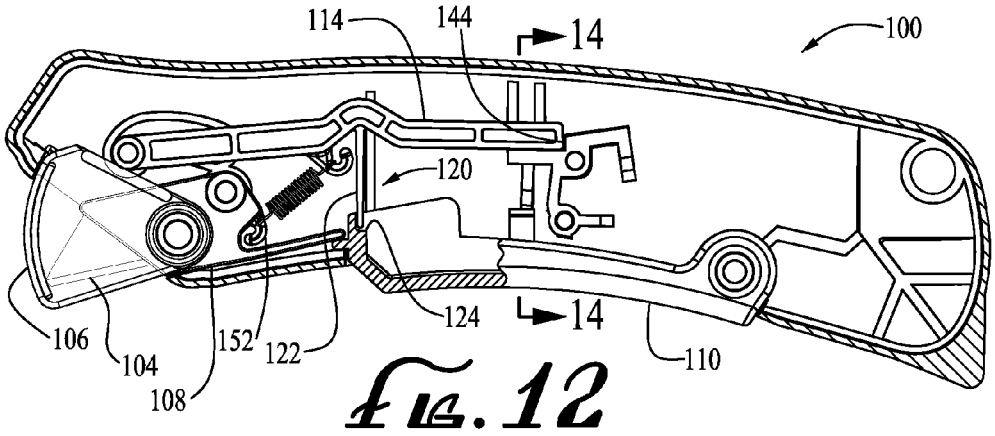
FIG. 12 is a side cross-sectional view of the utility knife as shown in FIG. 2 taken along section 12-12, showing the safety mechanism in the safety position with the trigger released.

When the knife (100) is locked, the aft end (118) of the strut (114) is engaged or adjacent to the bracket (144) to prevent the retraction of the shield (106), as seen in FIG. 12. In the locked configuration, the deflecting member (122) extends down from the strut (114) such that the tip (182) is directly above or in contact with the seat portion (184) on the trigger (110). In this position, the linked mode, the deflecting member (122) and the seat member (124) are in compressive alignment, where a compressive or axially-directed force F may be transmitted through the separable linkage (120) upon trigger (110) actuation. The depression of the trigger (110) causes the seat portion (184) to move along with the trigger (110), causing lifting substantially in the upward direction in this embodiment. To effectively lift the strut (114) without buckling, the deflecting member (122) should extend from the strut (114) in a direction that is substantially parallel to the lift direction. In this embodiment, the deflecting member (122) extends in a near perpendicular direction from the strut (114), since the small rotation of the trigger (110) when depressed causes a near vertical lifting of the seat portion (184). The engagement between the tip (182) and the seat portion (184) may be maintained in the lift by simple frictional engagement or by shaping the seat portion with an incline or cup shape to control movement of the tip (182).

Figure 13:
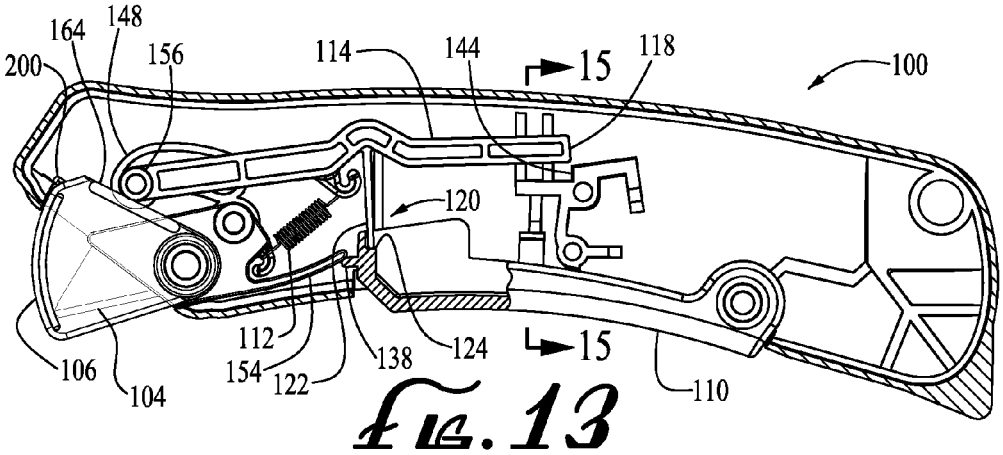
FIG. 13 is a side cross-sectional view of the utility knife as shown in FIG. 12, showing the separable linkage linked and lifting the strut with the trigger depressed.

FIG. 13 shows the trigger (110) being depressed against the bias of flexible arm (154). In this configuration, the deflecting arm (122) behaves much like an ideal slender column under load, where bending and buckling is minimized by directing the load along the lengthwise axis of the deflecting member (122). The seat portion (184) is contacting the tip (182) of the deflecting member (122) and exerting an axially-directed force F that is transmitted through the deflecting member (122) so that the depression of the trigger (110) causes a corresponding lifting of the strut (114). The spring (112) is attached at an angle between the blade holder (108) and strut (114) by hooks (150 and 152), creating a biasing force that pulls the strut (114) forward and towards the shield (106) and downwards to bias the aft end (118) towards the bracket (144). In FIG. 13 the strut (114) is contacting the back ends (164) of the fully extended shield (106), the tab (200) on the shield (106) serves to limit the outward extension of the shield (106) by contacting the inner wall of the body (132). The forward travel of the strut (114) is limited by either the back ends (164) of the shield (106) or the knobs' (156) travel within the arced groove (148). So, even though the spring (112) in FIG. 13 tends to pull the strut (114) forward, a substantial lateral force is not imparted on the deflecting member (122) due to the limiting of the strut's (114) forward travel, such that the deflecting member (122) would be buckled to an undesirable point.

With the trigger (110) depressed, the strut (114) is lifted or slightly rotated about knobs (156), where the aft end (118) is lifted above the wall (176) portion of the bracket (144), and corresponding wall portion (177) on second shell (136), so that the bracket (144) no longer obstructs the aft movement of the strut (114). In this unlocked configuration, the user (300) is permitted to begin cutting the workpeice (400) by applying the shield (106) to the workpeice surface to cause retraction of the shield (106).

Figure 16:
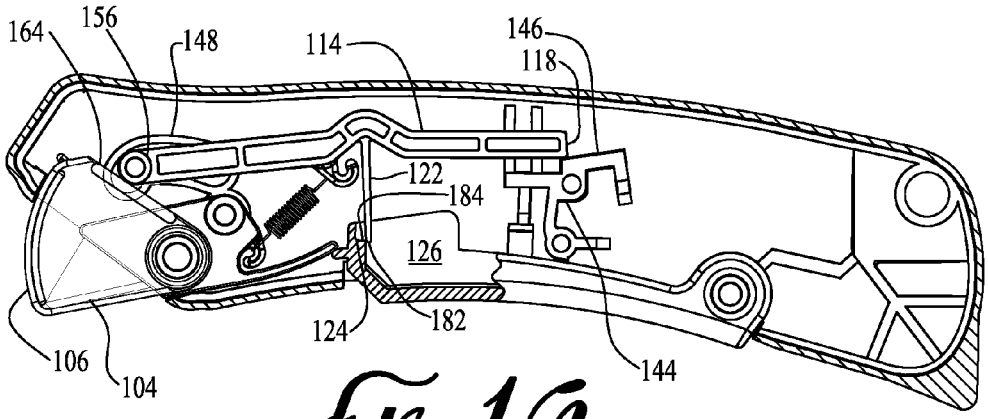
FIG. 16 is a side cross-sectional view of the utility knife as shown in FIG. 12, showing the separable linkage at the point of being delinked with the shield partially retracted and the strut longitudinally displaced.

FIG. 16 shows the shield (106) partially retracted so that the blade (104) is just about to be exposed. As the shield (106) is retracted, the back ends (164) of the shield (106) contact the knobs (156) of the strut (114) and pushes the strut (114) slightly upward at first, but thereafter, generally in the aft direction, indicated in FIG. 18 by an arrow. The knobs (156, 157) are restricted to travel within the arced groove (148) and opposing arced groove (149) respectively, so that the strut (114) may travel in the forward and aft directions and rotate about the knobs (156). The arced grooves (148, 149) formed on the first shell (134) and second shell (136) respectively may include a cornered portion (202) and (203) near the location of the extended shield (104) to provide additional bracing to the strut (114) when in the locked configuration and to permit the strut (114) to be easily pushed up and back as the shield (106) is retracted. Further, the optional sudden change in arc curvature of the arced grooves (148, 149) serves to further tension the spring (112) after unlocking, since the entire strut (114) is forced to move slightly upwards to further stretch the spring (112) and add additional force to quickly return the strut (114) to the locked position upon release of the shield (106).

Figure 17:
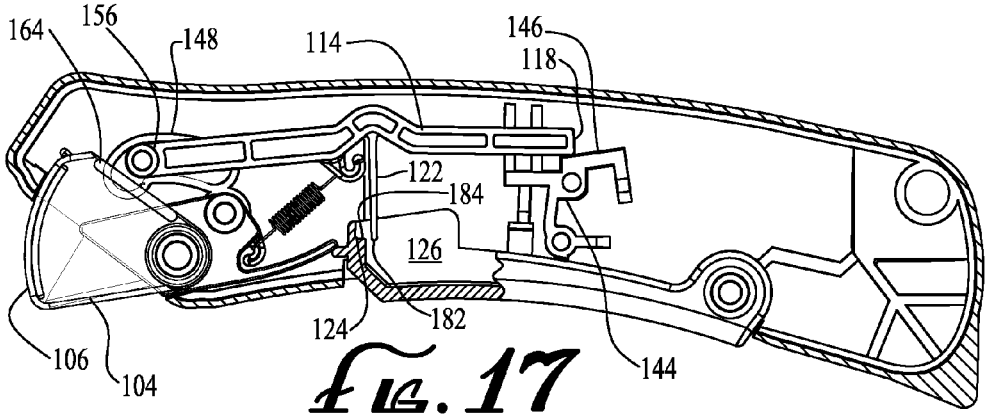
FIG. 17 is a side cross-sectional view of the utility knife as shown in FIG. 12, showing the separable linkage delinked with the shield further retracted and the strut further longitudinally displaced relative to the bracket.

As the strut (114) travels in the aft direction, the tip (182) likewise slides aft on the seat portion (184) until reaching the rightmost edge (as viewed in the figure) of the seat portion (184), where the tip (182) drops off the seat portion (184), so that the seat member (124) is no longer supporting the defecting member (122) and the two are therefore disengaged or in the delinked mode. Since the deflecting member (122) no longer can provide a lifting force to the strut (114), the strut (114) drops downward and the aft end (118) of the strut (114) is thereafter supported atop the bracket (144) on slide (146), and corresponding slide (147) on the second shell (136). At this point, the strut (114) may be further pushed in the aft direction by the further retraction of the shield (106), where the aft end (118) slides along the slide (146), as seen in FIG. 17. The tip (182) has completely moved away from and has separated from the seat portion (184), with the deflecting member (122) remaining at least partially within the channel as the deflecting member (122) moves aft. The shield (106) still covers the blade (104) in FIG. 17, although further retraction would expose the blade (104). In this scenario, just before blade (104) exposure, if the user were to lift the knife (100) from the material (400), the shield (106) would extend back over the blade (104) and the strut (114) would immediately drop back to the locked mode in front of the bracket (144), with the deflecting member (122) deflected as discussed below.

Figure 18:
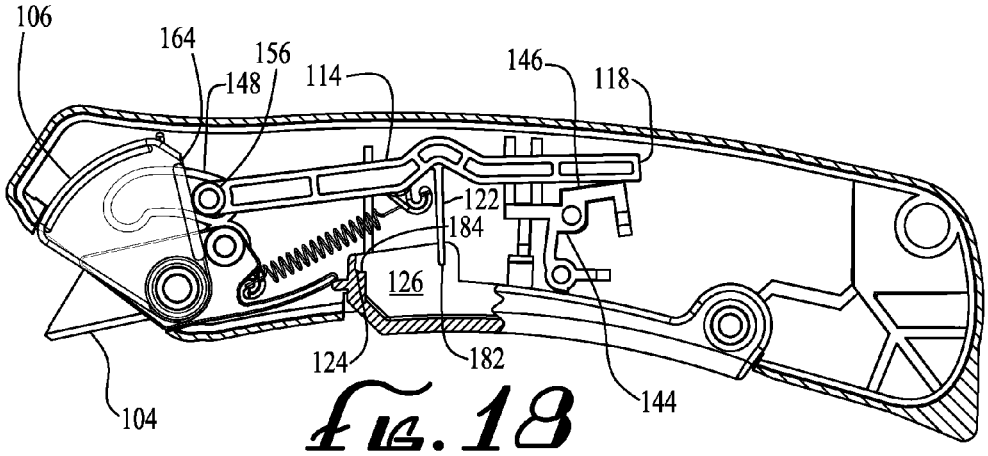
FIG. 18 is a side cross-sectional view of the utility knife as shown in FIG. 12, showing the separable linkage delinked with the shield fully retracted and the strut fully longitudinally displaced relative to the bracket.

FIG. 18 shows the shield (106) fully retracted with the blade (104) exposed (during a cutting operation as illustrated in FIG. 1). The knobs (156) have been pushed aft to the maximum displacement, as limited by the arced grooves (148). The aft end (118) has been pushed further aft, off the edge of the slide (146), but the strut (114) is still supported from beneath by the slide (146). Still, the deflecting member (122) remains within the channel (126). One purpose of the channel (126) is to control the side to side movement of the strut (114) by guiding the travel of the deflecting member (122). However, the channel (126) is not required for the knife (100) to operate.

Figure 19:
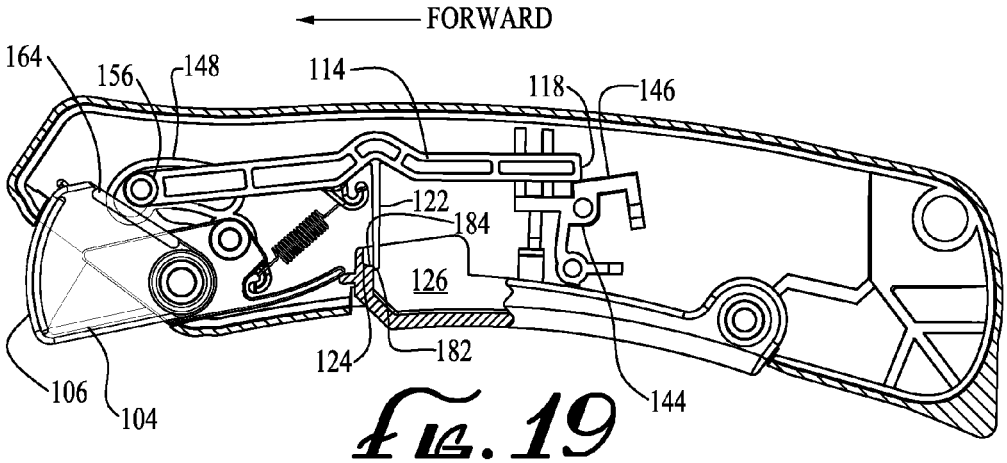
FIG. 19 is a side cross-sectional view of the utility knife as shown in FIG. 12, showing the separable linkage delinked with the shield extending and the strut moved longitudinally forward with the trigger still depressed.

Once a cut has been completed and the shield (106) removed from the workpeice (400), the shield (106) is biased to immediately extend back over the blade (104), as illustrated in FIG. 19. The shield (106) is almost completely extended over the blade (104), but not yet fully extended such that the safety mechanism can relock. The spring (112), as discussed above, is attached to the underside (196) of the strut (114) at an angle, so that a forward spring force component and a downward spring force component is exerted on the strut (114), where the forward direction is indicated by an arrow. The force produced by the spring (112) maintains contact between the slide (146) and the strut (114). The slide (146) may be angled down as it approaches forward to encourage the forward and downward movement of the strut (114) sliding thereon. FIG. 19 shows the aft end (118) on the slide (146), just before reaching the vertical wall (176) of bracket (144), corresponding to vertical wall (177) of bracket (145) on second shell (136). The angled slide (146) permits the aft end (118) to depart the slide (146) unhindered and drop in front of the wall (176) to relock the knife. The aft end (118) edges may have a chamfer or a radius to aid in this transition back to the locked configuration in front of the bracket (144).

Observing FIG. 19, it can be seen that the trigger (110) has remained depressed, the shield (106) is not fully extended, and the strut (114) has not reengaged the bracket (144). Therefore, the knife (100) remains unlocked in this illustration, but is on the verge of relocking. Looking particularly at the deflecting member (122) and the seat member (124), the tip (182) of the deflecting member (122) is no longer in compressive alignment with the seat member (124). The tip (182) is instead next to and slightly below the seat portion (184), so that further movement of the strut (114) in the forward direction would not cause the tip (182) transition back above the seat portion (184). Effectively, the tip (182) and the seat portion (184) will not be permitted to realign or return to the linked mode if the trigger (110) remains depressed.

Figure 20:
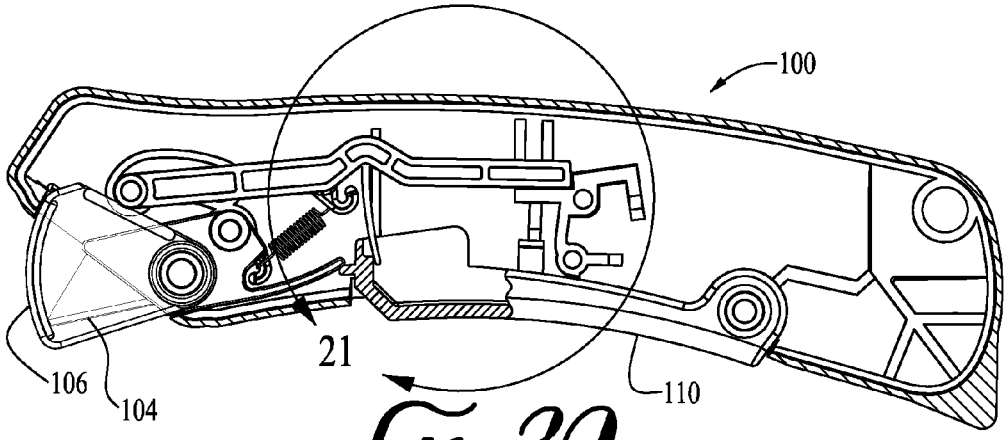
FIG. 20 is a side cross-sectional view of the utility knife as shown in FIG. 12, showing the separable linkage delinked with the shield fully extended and the strut in the safety position with the trigger still depressed and the deflecting member deflected in a longitudinal direction.
Figure 21:
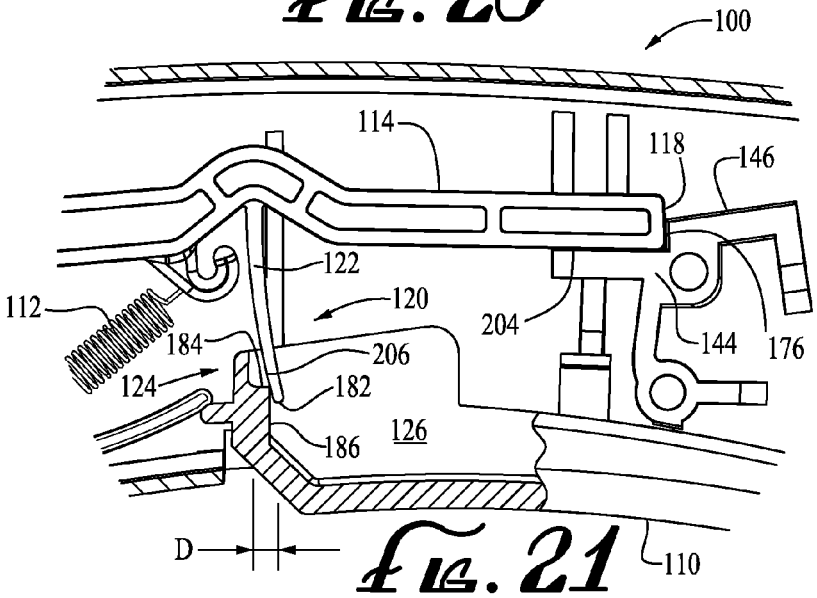
FIG. 21 is a magnified view of the utility knife as shown in FIG. 20, showing the deflected deflecting member preventing relinking of the separable linkage so long as the trigger remains depressed.

FIG. 20, and more particularly the magnified view of FIG. 20 shown in FIG. 21, shows the present knife (100) with the trigger (110) depressed and the safety mechanism in the locked configuration, where the shield (106) is fully extended over the blade (104) and the aft end (118) of the strut (114) is adjacent to and forward of the wall (176) of the bracket (144), where the strut (114) is returned to the safety position. The strut (114) is supported from the underside (196) by platform (204). Compared to FIG. 19, FIG. 20 shows the strut (114) moved slightly forward and slightly down. Since the tip (182) in FIG. 19 was shown misaligned with the seat portion (184), further movement of the strut (114) in the forward and down direction causes the deflecting member (122) to bend, in this example, with a deflection D in the aft direction due to the deflecting member's (122) side (206) contacting the deflector portion (186) of the seat member (124).

Because the deflecting member (122) bends in the aft direction, opposite of the direction of the strut's (114) longitudinal travel or path, the strut (114) is permitted to return to engagement with the bracket (144). So, the deflecting member (122) preferably should have structural characteristics that permit axial loads to be transmitted axially through it without significant buckling and permit bending when a lateral load is applied near the free end or tip (182). In this case, the lateral load or force is provided by the spring (112) pulling forward to cause an aft deflection (D). The deflection (D) is sufficient to enable the forward transition of the strut (114) shown from FIG. 19 to FIG. 20. In this example embodiment, the strut (114) moves forward and downwards when returning the locked mode, such that even if the deflecting member (122) were to land on the seat portion (184), there would be sufficient lateral force applied to the deflecting member (122) to cause the deflecting member (122) to bend or deflect and permit the strut (114) to still return to engagement with the bracket (144) and relock the knife.

The knife (100) will remain locked until the user (300) releases the trigger (110) and depresses the trigger (110) a second time. For example, when the user releases the trigger (110), the knife (100) will return to the configuration shown in FIG. 12, where the seat portion (184) has been lowered with the trigger (110), the deflector portion (186) has slid out of engagement with the side (206) of the deflecting member (122) so that the deflecting member (122) may elastically rebound to the straight or un-deflected state. Then, the seat portion (184) will once again be in compressive alignment with the tip (182), where the tip (182) is directly above or in contact with the seat portion (184), returned to the linked mode. In this way, the safety mechanism is once again ready for a second actuation, where the strut (114) may again be lifted for unlocking.

A unique and advantageous interaction is created between the deflecting member (122) and the seat member (124); when linked the deflecting member (122) transmits an axially-directed force from the seat member to the strut (114) during unlocking and when unlinked a lateral force deflects the deflecting member (122) to prevent the relinking of the deflecting member (122) and seat member (124). Because the deflection (D) in this example is opposite of the strut's (114) forward movement and no precise mating of deflecting parts in required, the looser tolerances are possible while maintaining reliable operation. This overall, among other important advantages, reduces complexity and cost of manufacturing, while maintaining performance, which is paramount in the disposable knife industry.

What is claimed is:

1. A safety mechanism for a utility knife, the utility knife having an elongate body with a blade extending therefrom and a shield retractably shielding the cutting edge of the blade, the safety mechanism comprising:

an actuator with a stepped member, the stepped member having a seat surface; and a rigid strut with a deflecting member extending from the strut, the strut having an initial position where the strut is engaged between the shield and a bracket to prevent retracting of the shield and the deflecting member is positioned above the seat surface, the bracket being fixed to the elongate body;

wherein movement of the actuator is transmitted to the strut through the deflecting member being lifted by the seat surface such that the strut is disengaged from the bracket;

and wherein once the strut is disengaged from the bracket, the retracting of the shield causes movement of the strut in a substantially longitudinal direction relative the bracket, and causes delinking of the seat surface and the deflecting member;

and wherein continued pressing of the actuator prevents the deflecting member from being repositioned above the seat surface, even as the shield returns to covering the blade due to the deflecting member being deflected in the substantially longitudinal direction by lateral contact with the stepped member.

2. The safety mechanism of claim 1, wherein the deflecting member is cantilevered from the strut to form a column of elongated cross section, where the elongated cross section permits bending of the deflecting member.

3. The safety mechanism of claim 1, wherein the actuator has a channel configured to receive therein a portion of the deflecting member when the actuator is depressed.

4. The safety mechanism of claim 1, wherein the delinking of the seat surface from the deflecting member prevents the movement of the actuator from being transmitted to the strut through the separable linkage, the repositioning of the deflecting member above the seat surface being permitted only upon release of the actuator.

5. The safety mechanism of claim 1, wherein the shield is mounted within the body of the utility knife and extending therefrom for shielding the cutting edge of the blade and being retractable within the body to expose the cutting edge.

6. The safety mechanism of claim 1, wherein compressive axial force is transmitted from the seat surface and through the deflecting member upon pressing the actuator.

7. The safety mechanism of claim 6, wherein the deflecting member is configured to resist substantial axial buckling as a result of the compressive axial force.

8. The safety mechanism of claim 1, wherein a detent provides resistance to hinder unintended pressing of the actuator.

9. The safety mechanism of claim 8, wherein the detent has a flexing arm extending from the actuator that engages and rides over a protrusion formed on the body of the utility knife as the actuator is pressed.

10. The safety mechanism of claim 1, wherein the blade is permanently fixed to the body of the utility knife.

11. The safety mechanism of claim 10, wherein the blade holder comprises a flexible arm extending to the actuator, for biasing the actuator further to a non-pressed position.

12. The safety mechanism of claim 1, wherein the deflecting member is integrally molded and cantilevered from the strut.

13. The safety mechanism of claim 12, wherein the deflecting member is configured for elastic bending.

14. The safety mechanism of claim 12 wherein, the strut is spring biased to engage the bracket in the safety position.

15. A safety mechanism for a utility knife, the utility knife having an elongate body with a blade extending therefrom and a shield retractably shielding the cutting edge of the blade, the safety mechanism comprising:

an actuator with a stepped member, the stepped member having a seat surface;

a strut displaceably coupled to a bracket, the strut in an initial safety position engaged between the shield and the bracket to prevent retracting of the shield; and a member extending transversely relative to the strut, the member terminating at a deflectable tip portion;

wherein the seat surface is configured to releasably engage the deflectable tip portion of the member while in the initial position;

and wherein the depression of the actuator is transmitted to the strut for disengaging the strut from the bracket;

and wherein once the strut is disengaged from the bracket, the retracting of the shield causes movement of the strut relative the bracket, and disengagement of the seat surface from the deflectable tip portion;

and wherein continued pressing of the actuator prevents reengagement of the seat surface and the deflectable tip portion, even as the shield returns to covering the blade, due to the member being deflected in a substantially aft direction away from the seat member.

16. The safety mechanism of claim 15 wherein, the seat surface receives the deflectable tip portion of the member in touching engagement.

* * * * *